US005513086A

United States Patent [19]

Ho

[11] Patent Number: 5,513,086

[45] Date of Patent: Apr. 30, 1996

[54] ULTRAVIOLET-REDUCED HALOGEN LAMP

[76] Inventor: Cheng-hsiung Ho, 14F-4, No. 1, Paoshen Rd., Yungho City, Taipei, Taiwan

[21] Appl. No.: 397,403

[22] Filed: Mar. 2, 1995

[51] Int. Cl.[6] ..... F21V 9/00

[52] U.S. Cl. ..... 362/293; 362/363; 313/116

[58] Field of Search ..... 313/112, 116, 313/579, 580, 635; 362/293, 363, 355

[56] References Cited

U.S. PATENT DOCUMENTS 5,036,244 7/1991 Shaffer ..... 313/116

*Primary Examiner*—Stephen F. Husar

*Attorney, Agent, or Firm*—Ralph F. Crandell; Holland & Hart

[57] ABSTRACT

An ultraviolet-reduced halogen lamp includes a base defining a central cavity, two apertures in communication with the central cavity and an annular groove, a halogen lamp bulb including two pins projecting therefrom, a lens including an annular edge and a mixture of aluminum oxide and silica coated on an internal surface of the lens. The lamp bulb is received in the central cavity while the pins are inserted through the apertures. The halogen lamp bulb is received in the lens while the annular edge is received in the annular groove.

1 Claim, 1 Drawing Sheet

ULTRAVIOLET-REDUCED HALOGEN LAMP

BACKGROUND OF THE INVENTION

This invention relates to an ultraviolet-reduced halogen lamp.

Halogen lamp bulbs are commonly used in situations wherein high levels of illumination are required, such as floodlighting a patio where a party or barbecue may be held. However, the light emitted from a halogen lamp bulb includes some harmful components, e.g., ultraviolet light with wavelengths within a certain range, which is believed to cause skin cancers. Thus, it is provide a halogen lamp in which the level of ultraviolet light has been reduced to allow people to have recreational activities illuminated well but with them having the fear of developing skin cancers.

SUMMARY OF THE INVENTION

It is the primary objective of this invention to provide a halogen lamp bulb with a lens for eliminating harmful light emitted by means of the halogen lamp bulb.

DETAILED DESCRIPTION OF THE INVENTION

Figure 1:
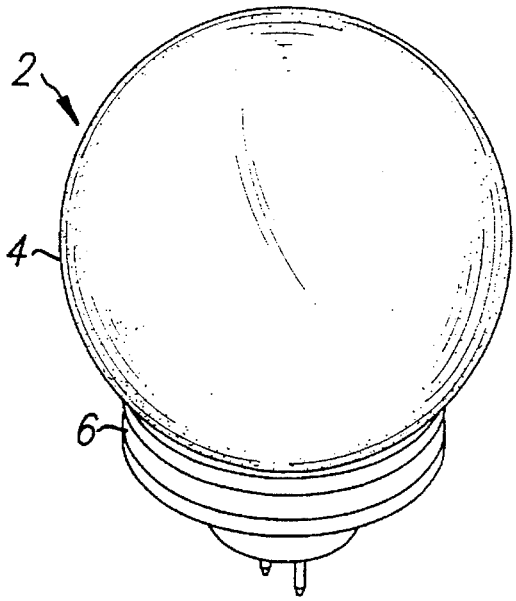
FIG. 1 is a perspective view of an ultraviolet-reduced halogen lamp according to this invention.

FIG. 1 shows a halogen lamp 2 including a lens 4 and a base 6.

Figure 2:
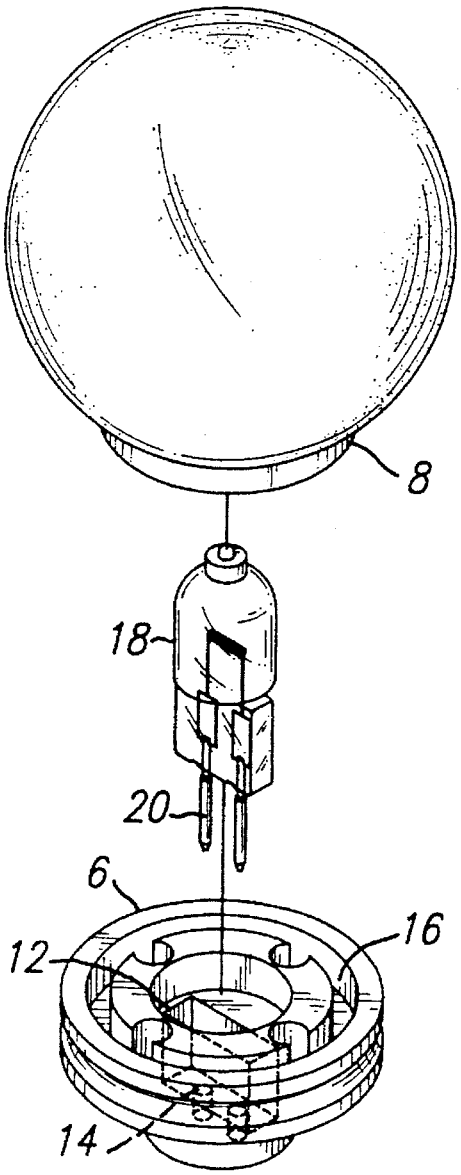
FIG. 2 is an exploded view of the halogen lamp as shown in FIG. 1.
Figure 3:
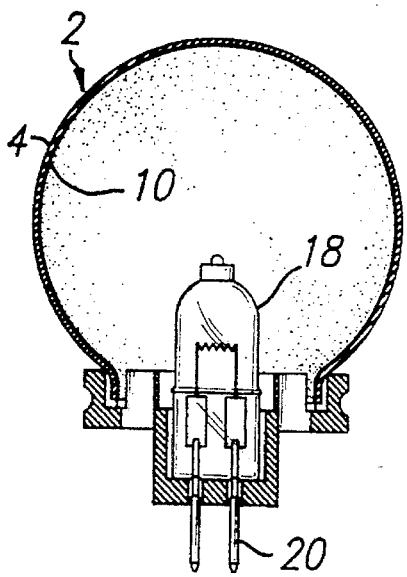
FIG. 3 is a cross-sectional view of the halogen lamp as shown in FIG. 1.

Referring to FIGS. 2 and 3, the lens 4 is in the form of a spherical bulb including an annular edge 8. A coating 10 of mixture of aluminum oxide and silica is dispersed onto an internal surface of the lens 4.

The base 6 is made of ceramic material so that it is electrically isolating. The base 6 defines a central cavity 12, two apertures 14 in communication with the central cavity 12 and an annular groove 16.

The halogen lamp 2 includes a conventional halogen lamp bulb 18 including two pins 20 projecting therefrom.

The halogen lamp bulb 18 is received in the central cavity 12 while the pins 20 are inserted through the apertures 14. Glue is provided into the central cavity 12 for adhering the halogen lamp bulb 18 to the base 6. The annular edge 8 is received in the annular groove 16. Glue is provided into the annular groove 16 for adhering the lens 4 to the base 6.

In use, the halogen lamp bulb 18 emits light including some harmful components, e.g., ultra-violet light. The harmful component of the light will be filtered out by means of the coating 10.

I claim:

1. A halogen lamp comprising a base defining a central cavity, two apertures in communication with the central cavity and an annular groove, a halogen lamp bulb including two pins projecting therefrom wherein the lamp bulb is received in the central cavity while the pins are inserted through the apertures, a lens including an annular edge and a mixture of aluminum oxide and silica coated on an internal surface of the lens, wherein the halogen lamp bulb is received in the lens while the annular edge is received in the annular groove.

* * * * *